US010927437B2

(12) United States Patent
Kernig et al.

(10) Patent No.: US 10,927,437 B2
(45) Date of Patent: Feb. 23, 2021

(54) ALUMINIUM STRIP FOR LITHOGRAPHIC PRINTING PLATE SUPPORTS WITH HIGH FLEXURAL FATIGUE STRENGTH

(75) Inventors: Bernhard Kernig, Cologne (DE); Jochen Hasenclever, Bonn (DE); Henk-Jan Brinkman, Bonn (DE); Gerd Steinhoff, Dormagen (DE); Christoph Settele, Mönchengladbach (DE)

(73) Assignee: Hydro Aluminium Deutschland GmbH, Grevenbroich (DE)

( * ) Notice: Subject to any disclaimer, the term of this patent is extended or adjusted under 35 U.S.C. 154(b) by 123 days.

(21) Appl. No.: 13/112,588

(22) Filed: May 20, 2011

(65) Prior Publication Data

US 2011/0290381 A1 Dec. 1, 2011

Related U.S. Application Data

(63) Continuation of application No. PCT/EP2009/065508, filed on Nov. 19, 2009.

(30) Foreign Application Priority Data

Nov. 21, 2008 (EP) ..... 08105850

(51) Int. Cl.
*C22C 21/06* (2006.01)
*C22F 1/04* (2006.01)
(Continued)

(52) U.S. Cl.
CPC ..... *C22C 21/06* (2013.01); *B41N 1/083* (2013.01); *C22C 21/00* (2013.01); *C22F 1/04* (2013.01); *C22F 1/047* (2013.01)

(58) Field of Classification Search
CPC . C22F 1/047; C22F 1/04; C22C 21/06; B41N 1/083
See application file for complete search history.

(56) References Cited

U.S. PATENT DOCUMENTS 4,715,903 A 12/1987 Asten et al.
4,818,300 A 4/1989 Rooy et al.
2008/0035488 A1* 2/2008 Martin ..... B41N 1/083 205/153

FOREIGN PATENT DOCUMENTS

EP 0239995 A2 10/1987
EP 0272528 A2 6/1988
(Continued)

OTHER PUBLICATIONS

Davis, J.R. "Aluminum and Aluminum Alloys", ASM International, 1993, p. 41.*
(Continued)

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

The invention relates to an aluminium alloy for the production of lithographic printing plate supports and also to an aluminium strip produced from the aluminium alloy, a process for the production of the aluminium strip and also its use for the production of lithographic printing plate supports. The object of providing an aluminium alloy as well as an aluminium strip from an aluminium alloy that permits the production of printing plate supports having improved bending-strength fatigue transverse to the rolling direction without adversely affecting the tensile strength values before and after the annealing process and while preserving the roughening properties, is achieved by the fact that the aluminium alloy contains the following alloy components in weight percent:

$0.4\% < Fe \leq 1.0\%$,
$0.3\% < Mg \leq 1.0\%$,
$0.05\% \leq Si \leq 0.25\%$,
$Mn \leq 0.25\%$, (Continued)

Cu≤0.04%,
Ti<0.1%,
the remainder being Al and unavoidable impurities, individually at most 0.05% and totaling at most 0.05%.

11 Claims, 1 Drawing Sheet

(51) Int. Cl.

| | |
|---|---|
| ***C22C 21/00*** | (2006.01) |
| ***C22F 1/047*** | (2006.01) |
| ***B41N 1/08*** | (2006.01) |

(56) References Cited

FOREIGN PATENT DOCUMENTS

| | | | |
|---|---|---|---|
| EP | 1065071 | A1 | 1/2001 |
| EP | 1880861 | A1 | 1/2008 |
| EP | 2 067 871 | A1 | 6/2009 |
| JP | 55-79850 | A | 6/1980 |
| JP | 61026746 | A | 2/1986 |
| JP | 62-181190 | A | 8/1987 |
| JP | 62181191 | A | 8/1987 |
| JP | 63-135294 | A | 6/1988 |
| JP | 11-61364 | A | 3/1999 |
| JP | 2000096172 | A | 4/2000 |
| JP | 2005-2429 | A1 | 1/2005 |
| JP | 2007-83256 | A | 4/2007 |
| WO | WO 2007045676 | A1 * | 4/2007 |

OTHER PUBLICATIONS

Dietrich G. Altenpohl, "Technology, Applications, and Environment," A Profile of Modern Metal, Aluminum from Within, 6th Edition, Jan. 11, 2000, 3 pages, The Aluminum Association, Inc., Washington, D.C.

Catrin Kammer, "Aluminium-Taschenbuch, Band 1: Grundlagen und Werkstoffe," 1995, 3 pages, Aluminium-Verlag, Düsseldorf, Germany.

G. Forrest, "Fatigue Properties of Aluminium Alloys," Sheet Metal Industries, Nov. 1957, 17 pages.

J.C. Grosskreutz et al., "Critical Mechanisms in the Development of Fatigue Cracks in 2024-T4 Aluminum," Midwest Research Institute, Technical Report, May 1968, 38 pages.

William M. Johnston, "Fracture Tests on Thin Sheet 2024-T3 Aluminum Alloy for Specimens With and Without Anti-Buckling Guides," NASA/CR-2001-210832, Mar. 2001, 40 pages, Analytical Services and Materials Inc., Hampton, Virginia.

L. J. Cartmell et al., "Hot Rolling of Sheet and Strip: Aluminium and Aluminium Alloys," Jul.-Aug. 1975, 5 pages, Metals Technology, München, Germany.

Normen, Aluminium 1—Bänder, Bleche, Platten, Folien, Butzen, Ronden, Geschweißte Rohre, Vormaterial, DIN-Taschenbuch 450, Dec. 1, 1997, 22 pages, DIN Deutsches Institut für Normung e.V., Germany.

Catrin Kammer, Aluminium-Taschenbuch, 15. Auflage, Band 1: Grundlagen and Werkstoffe, Jan. 1, 1995, 4 pages, Aluminium-Verlag, Germany.

* cited by examiner

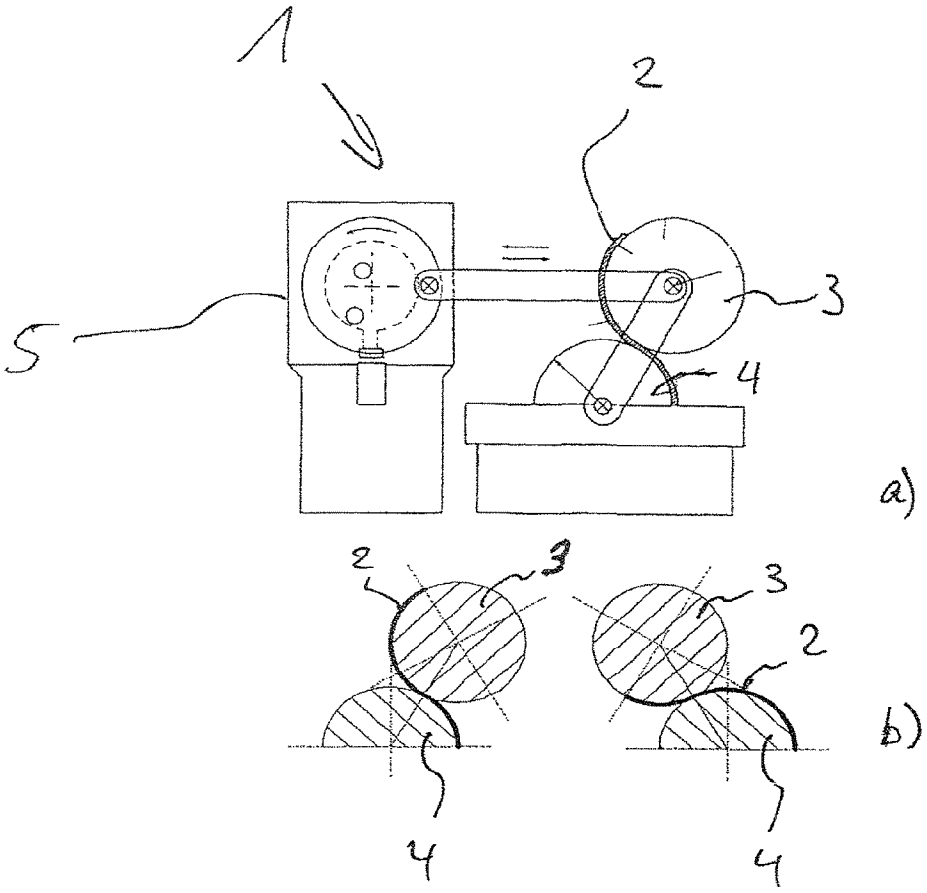
1
2
3
4
5
a)
b)

ALUMINIUM STRIP FOR LITHOGRAPHIC PRINTING PLATE SUPPORTS WITH HIGH FLEXURAL FATIGUE STRENGTH

CROSS-REFERENCE TO RELATED PATENT APPLICATIONS

This patent application is a continuation of pending PCT Patent Application No. PCT/EP2009/065508, filed Nov. 19, 2009, which claims the benefit of European Application No. 08105850.5 filed Nov. 21, 2008, the entire teachings and disclosure of which are incorporated herein by reference thereto.

FIELD OF THE INVENTION

The present invention relates to an aluminium alloy for the production of lithographic printing plate supports as well as an aluminium strip produced from the aluminium alloy, a process for the production of the aluminium strip, and also its use for the production of lithographic printing plate supports.

BACKGROUND OF THE INVENTION

Lithographic printing plate supports are mainly produced from aluminium alloys, typical thicknesses of the printing plate supports being between 0.15 mm and 0.5 mm. Lithographic printing plate supports have to meet increasingly stringent technical requirements. These result from the fact that ever larger numbers of prints have to be achievable with printing machines. In addition the printing plate support must be as large as possible in order to maximise the printing area per print. Since the printing plate supports are fabricated from aluminium strips, these are naturally limited in their width to somewhat less than the width of the aluminium strip. The printing plate supports are therefore increasingly clamped transverse to the rolling direction in printing machines, which means that in particular the flexural fatigue strength of the printing plate supports transverse to the rolling direction becomes important. In addition to a good flexural fatigue strength transverse to the rolling direction, a good roughening behaviour as well as the highest possible heat resistance are required. These requirements result from the fact that the aluminium strip used for the production of lithographic printing plate supports is previously subjected to an electrochemical roughening, which is intended to achieve a roughening as homogeneous as possible over the whole surface. The photosensitive layer applied to the surface is normally annealed at temperatures between 220° C. and 300° C. with annealing times of 3 to 10 minutes. The annealing process of the photosensitive layer should not lead to any excessive loss of strength in the printing plate support, so that the printing plate support can still be handled without difficulty and easily clamped in a printing device. At the same time the printing plate support must be highly stable in the printing device so as to allow the largest possible number of prints. A printing plate support must therefore have a sufficient flexural fatigue strength so that plate cracking on account of mechanical overloading of the printing plate support cannot occur. Above all, however, the flexural fatigue strength transverse to the rolling direction becomes increasingly important since many printing plate supports are clamped perpendicular to the rolling direction and deflections occur not along, but transverse to the rolling direction.

A strip for the production of lithographic printing plate supports is known from European Patent EP 1 065 071 B1 belonging to the applicant, which is characterised by a good ability to be roughened combined with a high flexural fatigue strength and a sufficient thermal stability after an annealing process. On account of the increasing size of the printing machines and the resultant enlargement of the required printing plate supports the need has arisen, however, to improve still further the properties of this aluminium alloy and of the printing plate supports produced therefrom, without adversely affecting the ability of the aluminium strip to be roughened.

From a further international patent application belonging to the applicant an aluminium alloy for the production of lithographic printing plate supports is known, which allows a relatively high iron content of 0.4 wt. % to 1 wt. % and a relatively high manganese content of up to 0.3 wt. %. This aluminium alloy has been improved in particular as regards its strength properties after an annealing process. However, it was previously assumed that Mg contents of greater than 0.3 wt. % gives rise to problems in the electrochemical roughening of the aluminium strip.

SUMMARY OF THE INVENTION

Starting from the above background, the object of the present invention is to provide an aluminium alloy as well as an aluminium strip produced from an aluminium alloy that allows the production of printing plate supports with improved flexural fatigue strength transverse to the rolling direction, without the tensile strength values before and after the annealing process being affected while preserving the roughening properties. At the same time the object of the present invention is to provide a process for producing an aluminium strip that is particularly suitable for the production of lithographic printing plate supports.

According to one embodiment of the present invention, the above object is achieved by an aluminium alloy for the production of lithographic printing plate supports in that the aluminium alloy contains the following alloy components in weight percent:

$0.4\% < Fe \leq 1.0\%$,
$0.3\% < Mg \leq 1.0\%$,
$0.05\% \leq Si \leq 0.25\%$,
$Mn \leq 0.25\%$,
$Cu \leq 0.04\%$,
$Ti < 0.1\%$,
the remainder being Al and unavoidable impurities, individually at most 0.01% and totalling at most 0.05%.

In contrast to the previously used aluminium alloys for the production of lithographic printing plate supports, which overall have very low proportions of iron and magnesium, it has been found that the aluminium alloy according to the invention provides in particular an improved flexural fatigue strength transverse to the rolling direction with constant tensile strength values after an annealing process. The flexural fatigue strength transverse to the rolling direction, in particular after an annealing process at 280° C. for 4 minutes, can be increased by more than 40% with the aluminium alloy according to the invention compared to previously used aluminium alloys. It is assumed that the combination of relatively high magnesium and iron contents in the aluminium alloy according to the invention are responsible for the improved flexural fatigue strength. Problems that were expected particularly with regard to the roughening ability of an aluminium strip produced from the specified aluminium alloy surprisingly did not occur, however. Despite the high Mg contents of 0.3 wt. % to 1 wt. % no problems in the roughening ability, in particular no streaking, were encountered. The improved flexural fatigue strength transverse to the rolling direction is attributed to the combination of iron contents of more than 0.4 wt. % to 1 wt. % with magnesium contents of more than 0.3 wt. % to 1 wt. %. Above 1 wt. % magnesium or iron, significant problems are expected as regards the ability of lithographic printing plate supports to be roughened.

Silicon in an amount of 0.05 wt. % to 0.25 wt. % produces a large number of sufficiently deep depressions in electrochemical etching, so that an optimal absorption of the photosensitive lacquer is ensured.

Copper should be restricted to at most 0.04 wt. % in order to avoid inhomogeneous structures during roughening. Titanium is incorporated only for the purpose of grain refining and in amounts higher than 0.1 wt. % leads to problems during roughening. Manganese in combination with iron, however, can improve the properties of an aluminium strip produced from the aluminium alloy, after an annealing process, so long as the proportion of manganese does not exceed 0.25 wt. %. Above 0.25 wt. % it is expected that coarse precipitations will adversely affect the roughening properties.

According to a first configuration of the aluminium alloy according to the invention, the aluminium alloy has the following Fe content in weight percent:

$0.4\% < Fe \leq 0.65\%$.

Aluminium alloys with the aforementioned iron contents exhibited a very consistent ability to be roughened apart from an increase in the flexural fatigue strength of the as-rolled state transverse to the rolling direction after an annealing process.

According to a further configuration of the aluminium alloy according to the invention, the aluminium alloy preferably has the following Mg content in weight percent:

$0.4\% \leq Mg \leq 1\%$, preferably $0.4\% \leq Mg \leq 0.65\%$.

Higher Mg contents lead to improved mechanical properties, especially after an annealing process. This effect becomes significant with Mg contents of at least 0.4 wt. %. An upper limit of 0.65 wt. % provides an optimal compromise between increase in strength with high flexural fatigue strength of the aluminium alloy transverse to the rolling direction, and consistent ability to be roughened. Mg contents above 1 wt. % promote the formation of streaks when roughening the aluminium strip. In experiments it was found, however, that with Mg contents between 0.4 wt. % and 0.65 wt. % there were no signs of problematic roughening properties. Magnesium contents of between 0.65 wt. % and 1 wt. % in addition resulted in excellent properties as regards flexural fatigue strength transverse to the rolling direction, although the execution of the roughening process can become more difficult on account of the increasing tendency to streak formation.

In addition, according to an improved embodiment of the aluminium alloy according to the invention the microstructure of the aluminium alloy can be improved still further if the aluminium alloy contains the following alloy components in weight percent:

$Ti \leq 0.05\%$, $Zn \leq 0.05\%$ and $Cr < 0.01\%$.

In particular the production properties of the aluminium alloy as regards the casting of the rolling slab and also the grain refining are improved by the specified contents of the alloy components. Zinc on account of its electrochemically reactive properties has a particularly marked influence on the roughening properties and should therefore be limited to at most 0.05 wt. %. Chromium contents of at least 0.01 wt. % lead to the formation of precipitates and likewise have a negative influence on the ability to be roughened.

The aluminium alloy preferably has an Mn content of at most 0.1 wt. %, preferably at most 0.05 wt. %. On account of the high Mg and Fe contents of the aluminium alloy manganese in the aluminium alloy according to the invention contributes only insignificantly to improving the tensile strength values after an annealing process and can therefore be reduced to a minimum.

According to a second embodiment of the present invention the object specified above is achieved by an aluminium strip for the production of lithographic printing plate supports consisting of an aluminium alloy according to the invention with a thickness of 0.15 mm to 0.5 mm. The aluminium strip according to the invention is, as already mentioned, characterised by an outstanding flexural fatigue strength transverse to the rolling direction, in particular also after an annealing process.

If the aluminium strip in the as-rolled state has a tensile strength Rm of less than 200 MPa along the rolling direction and after an annealing process at a temperature of 280° C. for 4 minutes a tensile strength Rm of more than 140 MPa as well as a flexural fatigue strength transverse to the rolling direction of at least 2000 cycles in the alternating bending fatigue test, then the aluminium strip can be used particularly advantageously for the production of oversize lithographic printing plate supports. The printing plate supports can then be handled particularly easily in the as-rolled state and also after an annealing process. In particular the printing plate supports produced therefrom have an improved service life.

The object mentioned above is according to a third embodiment of the present invention achieved by the use of an aluminium strip according to the invention for the production of printing plate supports, since these can then be fabricated in larger sizes in a consistent manner and clamped in large printing devices. In addition these printing plate supports have an improved service life on account of the higher flexural fatigue strength transverse to the rolling direction and do not tend to develop cracks.

Finally, according to a fourth embodiment of the present invention the object mentioned above is achieved by a process for the production of an aluminium strip for lithographic printing plate supports consisting of an aluminium alloy according to the invention, in which a rolling slab is cast, the rolling slab is optionally homogenised at a temperature of 450° C. to 610° C., the rolling slab is hot rolled to a thickness of 2 mm to 9 mm, and the hot strip, with or without an intermediate annealing, is cold rolled to a final thickness of 0.15 mm to 0.5 mm. The intermediate annealing, if such is carried out, is performed so that due to the following cold rolling process to the final thickness, a desired final strength of the aluminium strip in the as-rolled state is established. As already mentioned, this is preferably just below 200 MPa.

Preferably the intermediate annealing is performed at an intermediate thickness of 0.5 mm to 2.8 mm, the intermediate annealing being carried out in the coil or in a straight-through annealing furnace at a temperature of 230° C. to 470° C. The final strength of the aluminium strip can be adjusted depending on the intermediate thickness of the strip at which the intermediate annealing is carried out. In addition, by using the aluminium alloy according to the invention to produce a strip for lithographic printing plate supports the flexural fatigue strength transverse to the rolling direction of the aluminium strip can be significantly improved compared to the hitherto known aluminium alloys and the aluminium strips produced therefrom. Overall an increase of more than 40% in the alternating bending fatigue test is achieved.

There now exist a large number of possible ways of modifying and improving the aluminium alloy according to the invention, the aluminium strip according to the invention, its use, and also the process for producing the aluminium strip. Reference is made in this connection to the subclaims dependent on claims 1, 6 and 9, as well as the description of exemplary embodiments in conjunction with the drawing.

BRIEF DESCRIPTION OF THE DRAWINGS

FIG. 1 illustrates a schematic illustration of an experimental arrangement for performing alternating bending fatigue tests as described herein.

DETAILED DESCRIPTION OF THE INVENTION

Table 1 shows the alloy compositions of two aluminium alloys V1, V2, which as comparison examples show compositions of aluminium alloys previously used for printing plate supports. In contrast to this the aluminium alloys I1 to I4 according to the invention have significantly higher magnesium and iron contents. Rolling slabs were cast from the alloys V1 to I4. The rolling slabs were then homogenised at a temperature of 450° C. to 610° C. and hot rolled to a thickness of 4 mm. Cold rolling was then carried out to a final thickness of 0.28 mm. The comparison alloy V2 did not undergo any intermediate annealing during the cold rolling, whereas the comparison alloy V1 as well as the aluminium alloys I1 to I4, underwent an immediate annealing. The intermediate annealing of the strips of the comparison alloy V1 took place at an intermediate thickness of 2.2 mm. In the case of the aluminium alloys I1 to I4 according to the invention, intermediate annealings were carried out at a thickness of 1.1 mm. The alloy constituents of the aluminium alloys V1 to I4 are shown in weight percent in Table 1.

TABLE 1

| Alloy | Mg | Fe | Si | Mn | Cu | Ti | Cr | Zn |
|---|---|---|---|---|---|---|---|---|
| V1 | 0.2 | 0.38 | 0.07 | 0.0021 | 0.0005 | 0.0031 | 0.0005 | 0.0101 |
| V2 | 0.11 | 0.41 | 0.07 | 0.0820 | 0.0029 | 0.0053 | 0.0005 | 0.0094 |
| I1 | 0.31 | 0.46 | 0.08 | 0.0024 | 0.0005 | 0.0040 | 0.0005 | 0.0077 |
| I2 | 0.37 | 0.46 | 0.08 | 0.0023 | 0.0005 | 0.0046 | 0.0005 | 0.0089 |
| I3 | 0.43 | 0.43 | 0.07 | 0.0025 | 0.0005 | 0.0054 | 0.0005 | 0.0091 |
| I4 | 0.45 | 0.61 | 0.07 | 0.0031 | 0.0006 | 0.0044 | 0.0006 | 0.0073 |

The strips produced from the aluminium alloys V1 to I4 were investigated on the one hand as regards their ability to be roughened. It was found that all the produced aluminium strips have a good ability to be roughened. Table 2 shows not only the ability of the aluminium alloys V1 to I4 to be roughened, but also the number of bending cycles that samples of the various aluminium alloys underwent in an alternating bending fatigue test. The alternating bending fatigue tests were carried out with an experimental arrangement schematically illustrated in FIG. 1. In this connection alternating bending fatigue tests were carried out along and transverse to the rolling direction on as-rolled aluminium strips and also on aluminium strips after an annealing process at 280° C. for 4 minutes.

FIG. 1*a*) shows in a diagrammatic sectional view the device 1 used for the alternating bending fatigue tests. In order to investigate the flexural fatigue strength, samples 2 are fixed in the alternating bending fatigue test device 1 on a movable segment 3 as well as on a stationary segment 4. In the alternating bending fatigue test the movable segment 3 is moved backwards and forwards on the stationary segment 4 with a rolling movement, so that the sample 2 is exposed to bending movements perpendicular to the length of the sample 2, FIG. 1*b*). In order to test the flexural fatigue strength transverse to the rolling direction, the samples simply have to be cut out transverse to the rolling direction and clamped in the device. The same also applies to samples cut out along the rolling direction. The radius of the bending segments 3, 4 is 30 mm.

The results of the alternating bending fatigue test given in Table 2 show that the aluminium alloys I1 to I4 according to the invention allow a significantly higher number of alternating bending cycles, particularly after an annealing process, than the comparison alloys. The increase compared to the comparison alloys V1 and V2 is more than 40%, and at most may even be more than 140% compared to the alloy V1.

This result is attributed inter alia to the combination of relatively high iron and magnesium contents in the aluminium alloys according to the invention. Despite the high magnesium and iron contents of the aluminium alloys according to the invention a good roughening behaviour of the aluminium alloys according to the invention is also observed, as can be seen from Table 2.

TABLE 2

| | Alternating bending fatigue test along the rolling direction | | Alternating bending fatigue test transverse to the rolling direction | | Ability |
|---|---|---|---|---|---|
| Alloy Identification | As-rolled | 280° C./ 4 min | As-rolled | 280° C./ 4 min | to be roughened |
| V1 | 3033 | 3398 | 1928 | 1274 | + |
| V2 | 2834 | 3154 | 2203 | 1929 | + |
| I1 | 4191 | 4323 | 2469 | 2721 | + |
| I2 | 4801 | 4573 | 2549 | 3176 | + |
| I3 | 4282 | 4568 | 2631 | 2906 | + |
| I4 | 3302 | 3421 | 2016 | 2871 | + |

In addition the aluminium alloys I1 to I4 according to the invention also exhibit the necessary tensile strength values for ease of handling of the printing plate supports, in particular when using oversize printing plate supports clamped transverse to the rolling direction. In the as-rolled state the aluminium strips I1 to I4 have tensile strengths Rm measured according to DIN of less than 200 MPa, and a coil set can therefore easily be removed. After the annealing procedure the tensile strength Rm of the aluminium strips I1 to I4 according to the invention is still more than 140 MPa, in order to facilitate a clamping of large printing plate supports in printing devices. This is also true of the yield strength Rp 0.2 measured according to DIN, which in the as-rolled state is less than 195 MPa and after the annealing process at 280° C. for 4 minutes is more than 130 MPa.

Only the comparison alloy, which had not undergone an intermediate annealing, shows in the as-rolled state values that are too high as regards the tensile strength Rm and also the yield strength Rp 0.2.

Although the values for the tensile strength and yield strength of the aluminium strips depend on the process parameters in the production of the aluminium strips, the aluminium alloys according to the invention nevertheless enable the preferred values to be achieved in a simple manner, for example with an intermediate annealing at 1.1 mm, and furthermore provide outstanding flexural fatigue strength properties combined with very good strength values.

TABLE 3

| | | Yield strength Rp 0.2 (MPa) | | Tensile strength Rm (MPa) | |
|---|---|---|---|---|---|
| Alloy identification | Intermediate Annealing | As-rolled | 280° C./ 4 min | As-rolled | 280° C./ 4 min |
| V1 | Yes | 193 | 136 | 197 | 145 |
| V2 | No | 210 | 148 | 218 | 156 |
| I1 | Yes | 178 | 135 | 185 | 147 |
| I2 | Yes | 180 | 133 | 186 | 147 |
| I3 | Yes | 183 | 136 | 191 | 150 |
| I4 | Yes | 186 | 140 | 194 | 154 |

The invention claimed is:

1. Aluminium strip for the production of lithographic printing plate supports, which are designed to be clamped transverse to the rolling direction in printing machines, wherein the strip has a thickness of 0.15 mm to 0.5 mm, characterised in that the aluminium alloy of the strip consists of the following alloy components in weight percent:

0.4%<Fe≤0.65%,
0.31%≤Mg≤0.37%,
0.07%≤Si≤0.25%,
Mn≤0.1%,
Cu≤0.04%,
Ti≤0.05%,
Cr≤0.0006%,
Zn≤0.05%, the remainder being Al and unavoidable impurities, individually at most 0.05% and totalling at most 0.15%, wherein the aluminium strip is in an as-rolled temper state and comprises a tensile strength Rm of less than 200 MPa.

2. Aluminium strip according to claim 1, characterised in that the aluminium alloy has an Mn content of at most 0.08 wt. %.

3. Aluminium strip according to claim 1, wherein the aluminium strip has after an annealing process at a temperature of 280° C. for 4 minutes a tensile strength Rm of more than 140 MPa as well as a flexural fatigue strength transverse to the rolling direction of at least 2000 cycles in an alternating bending fatigue test.

4. Aluminium strip according to claim 1, wherein the aluminium strip is used for the production of printing plate supports.

5. Aluminium strip according to claim 1, wherein the aluminium alloy has an Fe content of at most 0.5 wt. %.

6. Printing plate support, wherein the printing plate support is designed to be clamped transverse to the rolling direction in printing machines and is made from an aluminium strip according to claim 1.

7. A method, comprising:

utilizing the printing plate support according to claim 6, wherein the printing plate support is clamped transverse to the rolling direction in a printing machine.

8. A method for printing, the method comprising:

clamping the printing plate support according to claim 6 transverse to the rolling direction in a printing machine; and printing by means of the printing plate support and the printing machine.

9. A process for the production of an aluminium strip for lithographic printing plate supports according to claim 1, comprising casting a rolling slab, optionally homogenizing the rolling slab at a temperature of 450° C. to 610° C., hot rolling the rolling slab to a thickness of 2 mm to 9 mm, and cold rolling the hot aluminium strip, with intermediate annealing, to a final thickness of 0.15 mm to 0.5 mm.

10. Process according to claim 9, characterised in that an intermediate annealing is carried out at an intermediate thickness of 0.5 mm to 2.8 mm, the intermediate annealing taking place in a coil or in a straight-through furnace at a temperature of 230° C. to 470° C.

11. A method, comprising:

utilizing an aluminium alloy strip for the production of lithographic printing plate supports, which are designed to be clamped transverse to the rolling direction in printing machines, from an aluminium alloy strip with a thickness of 0.15 mm to 0.5 mm, wherein the aluminium alloy consists of the following alloy components in weight percent:

0.4%<Fe≤0.65%,
0.31%≤Mg≤0.37%,
0.07%≤Si≤0.25%,
Mn≤0.1%,
Cu≤0.04%,
Ti<0.05%,
Cr<0.0006%,
Zn≤0.05%, the remainder being Al and unavoidable impurities, individually at most 0.05% and totalling at most 0.15%, wherein the aluminium strip is in an as-rolled temper and has a tensile strength Rm of less than 200 MPa.

* * * * *